US007416380B2

(12) United States Patent
Burgess

(10) Patent No.: US 7,416,380 B2
(45) Date of Patent: Aug. 26, 2008

(54) PRESSURE RELIEF ARRANGEMENT FOR A PUMP

(75) Inventor: Kevin Edward Burgess, Carlingford (AU)

(73) Assignee: Weir Warman Ltd., Artarmon (AU)

( * ) Notice: Subject to any disclaimer, the term of this patent is extended or adjusted under 35 U.S.C. 154(b) by 450 days.

(21) Appl. No.: 10/557,459

(22) PCT Filed: May 17, 2004

(86) PCT No.: PCT/AU2004/000646

§ 371 (c)(1),
(2), (4) Date: Nov. 18, 2005

(87) PCT Pub. No.: WO2004/104423

PCT Pub. Date: Dec. 2, 2004

(65) Prior Publication Data

US 2007/0020083 A1 Jan. 25, 2007

(30) Foreign Application Priority Data

May 23, 2003 (AU) ..... 2003902582

(51) Int. Cl.
*F01D 21/00* (2006.01)

(52) U.S. Cl. ..... 415/9

(58) Field of Classification Search ..... 415/9, 415/126, 128, 206; 417/283, 900
See application file for complete search history.

(56) References Cited

U.S. PATENT DOCUMENTS 1,324,036 A * 12/1919 De Laval ..... 411/532
1,495,946 A * 5/1924 Bassett ..... 285/2
3,599,528 A * 8/1971 Kushnick ..... 411/337
3,711,218 A 1/1973 Kennel et al.
4,479,587 A * 10/1984 Mundt et al. ..... 220/89.2
5,129,659 A 7/1992 Ootsuka et al.
5,209,635 A 5/1993 Stewart et al.
5,219,274 A * 6/1993 Pawlowski et al. ..... 417/213
5,472,318 A 12/1995 Frank et al.

FOREIGN PATENT DOCUMENTS

| | | |
|---|---|---|
| CA | 1 220 399 | 4/1987 |
| DE | 41 16 697 C1 | 3/1992 |
| DE | 91 11 157 U1 | 1/1993 |
| FR | 2 290 133 A | 5/1976 |
| GB | 191026913 A | 11/1911 |
| GB | 2 203 491 A | 10/1988 |
| WO | WO 02/101245 A | 12/2002 |

* cited by examiner

*Primary Examiner*—Ninh H. Nguyen
*Assistant Examiner*—Aaron R Eastman
(74) *Attorney, Agent, or Firm*—Morriss O'Bryant Compagni

(57) ABSTRACT

A pressure relief arrangement for a pump (10) which includes a pump housing assembly with a pumping chamber (25) therein, the pump housing assembly including a section (41) mounted for movement between a normal operating position and a venting position, a shearing element (45) being adapted to retain the section in the normal operating position, the section (41) being mounted so that upon the pressure within the pumping chamber (25) can act on the section (41) and upon the pressure within the pumping chamber (25) reaching a specified pressure, the shearing element (45) will fail thereby permitting movement of the section (41) from the normal operating to the venting position.

9 Claims, 5 Drawing Sheets

PRESSURE RELIEF ARRANGEMENT FOR A PUMP

The present invention relates generally to pumps and more particularly, to a pressure relief arrangement for pumps.

Normal water pumps do not handle solids but it has been noted that when the flowrate is say, equal to or less than 10% than that of the maximum flowrate at any particular pump speed, the temperature of the liquid recirculating inside the pump will increase with time. The heat generated causes the pump casing and components to also increase in temperature. It is therefore quite common for manufacturers to recommend a minimum flowrate for a pump to avoid this problem area. Measurement and control of flowrate and therefore temperature for water pumps are relatively easy and there is a multitude of suitable equipment available. Some schemes involve a separate bypass to maintain flow through the pump.

Centrifugal Slurry Pumps are typically applied in a very wide range of industries and applications worldwide and most commonly in mining plants. The mixture of liquids (commonly water) and solids that make up the slurry that these slurry pumps handle are also very wide ranging. Similar to water pumps, slurry pumps will heat up if operated at low flowrates for any significant time. Low flow rates can be caused inadvertently by blockages occurring in the pump due to the slurry they are pumping. The heat generated can also be detrimental to the wear resistant hard metal or natural rubber liners commonly used in slurry pumps. In a worst case scenario it is possible that the steam generated from such overheating under pump blockage conditions may cause the pump to explode.

Slurry pumps are normally installed in quite similar types of arrangements with a hopper to gravity feed the slurry into the pump, followed by different length pipelines generally with bends, sloping or horizontal sections of pipework and in some cases valves or tanks are located along the pipeline to the final discharge point.

For measuring slurry flowrate or slurry fluid temperature there are relatively few options available, as slurry can easily clog or jam instruments and/or cause wear. Consequently, it is common practice to utilise very few instruments in the pumping of slurry and to rely on the continuous flow of slurry from one process to another. Slurry pump manufacturers and suppliers can provide a minimum flowrate for a slurry pump, but with the wide range of possible duties, change in slurry properties and the possibility of solids settling in the pipeline or pump, such minimum flowrate recommendations will not by themselves guarantee that the flowrate will not change or drop in service to critically low levels.

Transport of the slurry particles relies on maintaining a certain velocity in the pipeline; otherwise particles tend to settle out on the bottom of the pipe. As the velocity drops further, the solids will build-up in the pipeline and eventually may cause a blockage. A similar scenario can occur in a slurry pump operating at very low or zero flowrate. The solids start to settle out in the pump and can cause a blockage. Even if the pump is running, the pump can eventually become completely choked with solids.

All horizontal slurry pumps have a pump casing with an impeller rotating inside the casing, the impeller is attached to one end of a cantilevered shaft. The shaft rotates in bearings and enters the drive side of the pump casing through a seal chamber. The seal chamber is normally a separate component that is fitted at the back of the pump casing and takes a number of forms. One form is a stuffing box, which contains packing rings that seal the shaft as it passes through the seal chamber/pump casing wall. Another form is an expelling chamber. One or both of these two forms can be utilised regardless of the pump duty, liner material or application. Another type of sealing is by means of a mechanical seal. In all cases, the seal is contained in the seal chamber, which is supported by the pump casing.

The seal chamber at the drive side of the pump is supported by the pump casing and generally sealed at its periphery against the internal pump liner, which could be metal or elastomer material. The internal pressure inside the pump casing acts onto the inside surface of the seal chamber. The seal chamber is sealed against the main pump liner with a seal such as an O-ring seal or other type of elastomer seal.

It is an object of the present invention to provide a pressure relief arrangement for use pumps.

According to one aspect of the present invention there is provided a pressure relief arrangement for a pump which includes a pump housing assembly with a pumping chamber therein, the pump housing assembly including a side wall section mounted for movement between a normal operating position and a venting position, a shearing element being adapted to retain the side wall section in the normal operating position, the side wall section being mounted so that pressure within the pumping chamber can act on the side wall section, the arrangement being such that upon the pressure within the pumping chamber reaching a specified pressure the shearing element will fail thereby permitting movement of the side wall section from the normal operating to the venting position. In the venting position the pressure within the pumping chamber can be relieved.

In one form of the invention, the pump includes a pumping chamber and a sealing chamber in fluid communication therewith, the sealing chamber including a side wall section mounted for movement between an operative position and a venting position, the shearing element being adapted to retain the side wall in the operative position. The arrangement is such that upon the pressure within the sealing chamber reaching a specified pressure, the shearing element will fail thereby permitting movement of the side wall section from the operative position to the venting position.

The pump may include a casing having two parts operatively connected together with the pumping chamber therein. The pump may include an inlet and outlet as is conventional. An impeller may be provided within the pumping chamber and is adapted to be driven by a drive shaft.

The sealing chamber may form part of a sealing assembly, the side wall section being mounted for limited axial movement.

Preferably, the side wall section is mounted in an installed position relative to one of the parts of the housing. The pump casing and the side wall section may have cooperating shoulders thereon and the shearing element may be adapted to be disposed therebetween. In one form, the shearing element may include a ring shaped body having one or more shearing flanges projecting generally radially therefrom. In the installed position, one side edge of the ring is adapted to abut against one of the shoulders and the shearing flange is adapted to abut against another of the shoulders. The shoulders of the parts are spaced apart so that on failure of the shearing element axially movement between the two parts is permitted.

In another form the or each shearing flange is replaced with a protruding shear pin which is adapted to fit into a hole in the ring shaped body. In this embodiment the load is taken by the or each pin which fails in shear at a particular pressure.

There may further be provided means for inhibiting rotation of the side wall. In one form, such means may include one or more lugs which are adapted to abut against a part of the pump casing.

According to another aspect of the present invention there is provided a shearing element for use in the arrangement described above, the shearing element including a body portion and shearing lug or projection which is adapted to fail at a specified overpressure within the pump chamber. Preferably, the shearing element includes a ring shaped body with one or more lugs or pins extending radially therefrom. Preferably, two lugs are provided each having a length so as to provide for failure at an axially applied shear force resulting from a specified over pressure of the slurry within the pump.

Preferred embodiments of the invention will hereinafter be described with reference to the accompanying drawings and in those drawings.

Figure 1:
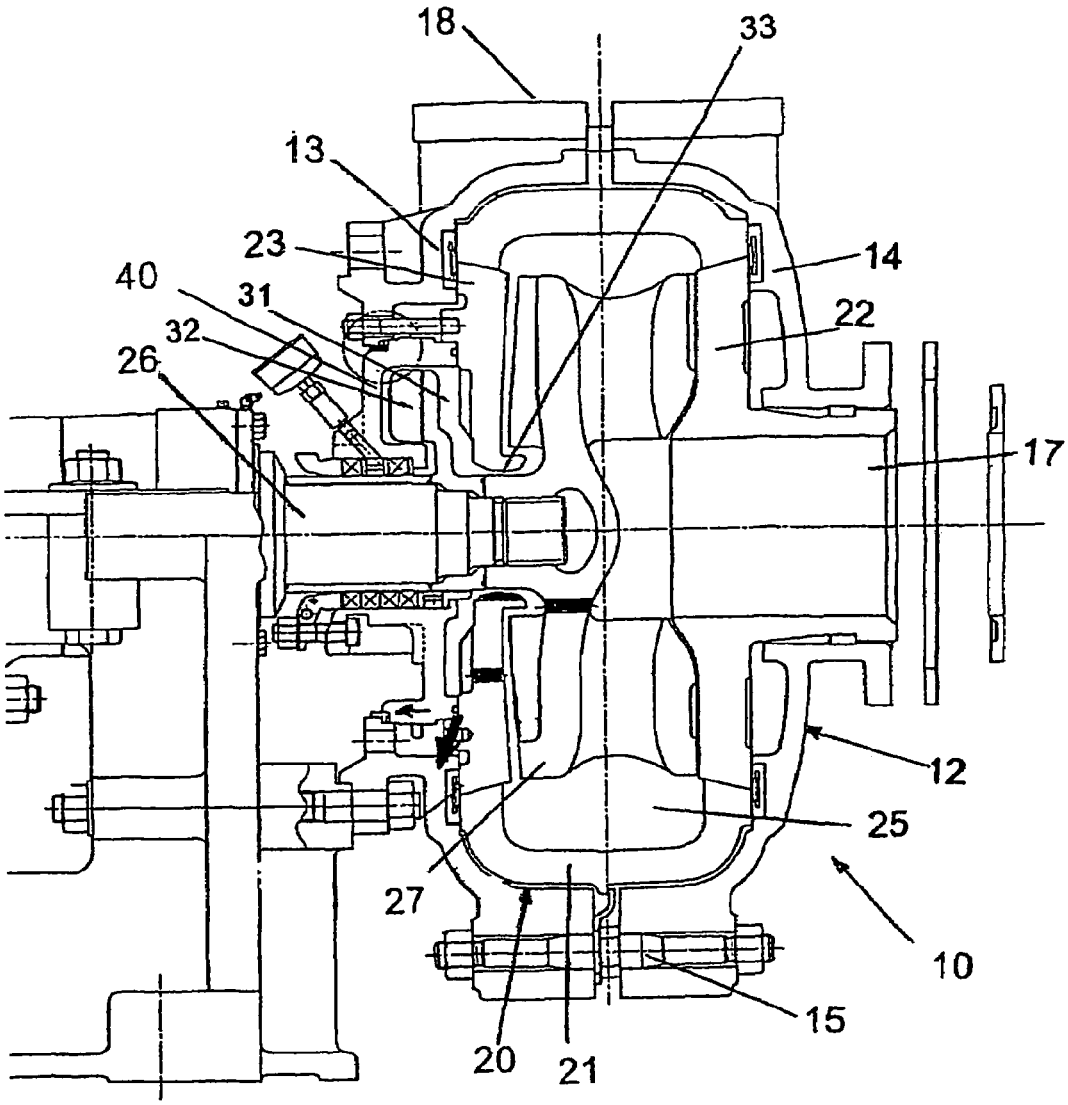
FIG. 1 is a schematic side elevation of a pump according to one embodiment of the present invention.
Figure 2:
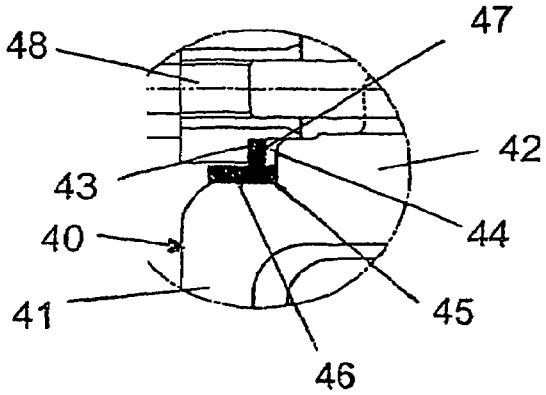
FIG. 2 is a detail from FIG. 1 of a seal ring of the present invention.
Figure 3:
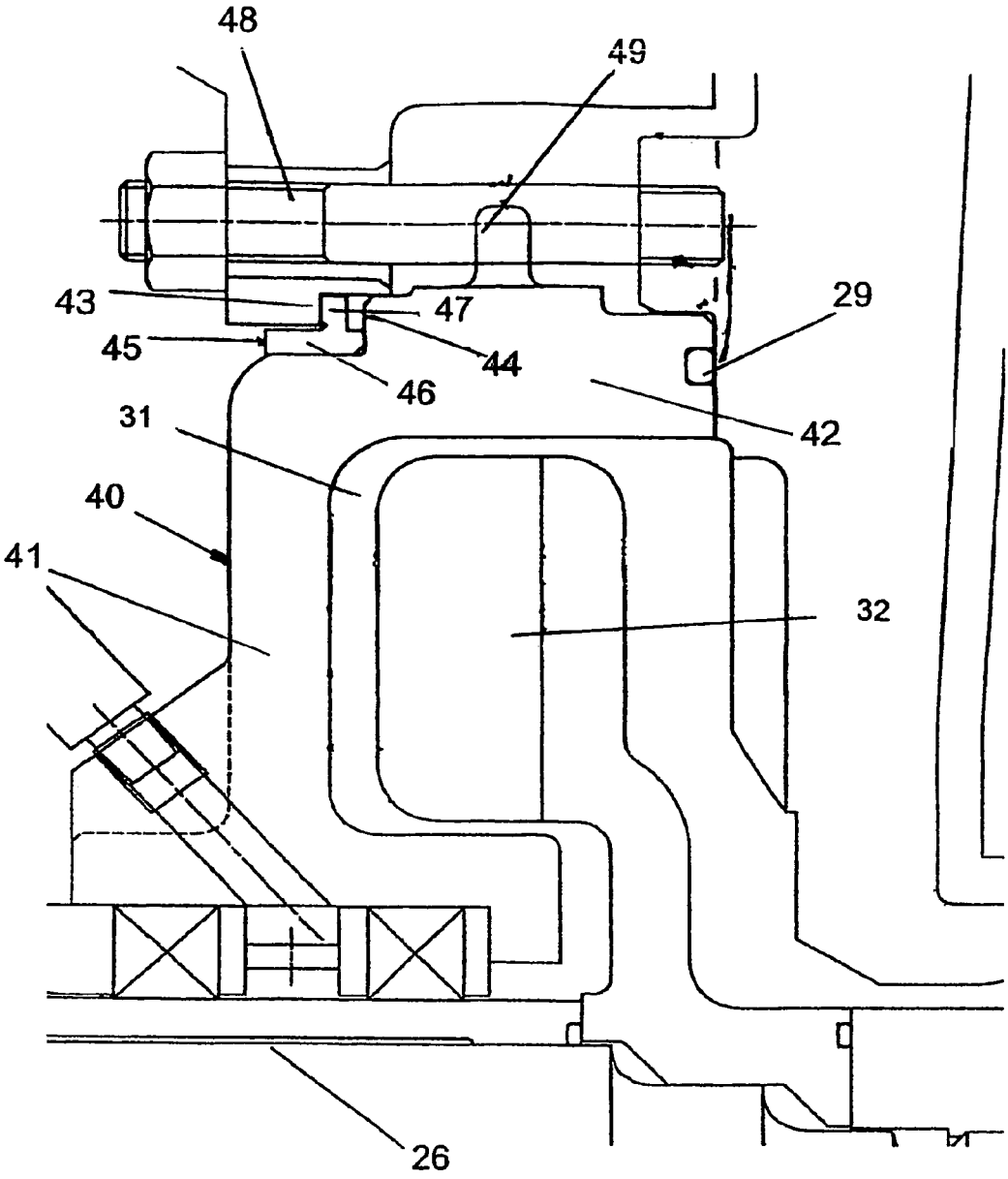
FIG. 3 is a further detail of part of the assembly of the pump of FIG. 1.

Referring to FIGS. 1 to 3 of the drawings there is shown a pump generally indicated at 10 which includes a housing assembly comprising a pump casing 12 including two parts 13 and 14 connected together by a series of bolts 15. The pump includes an inlet 17 and an outlet 18. A liner 20 is disposed within the pump casing and includes a peripheral section 21, an inlet section or throatbush 22 and a rear section 23. The pump further includes an impeller 27 disposed within a pumping chamber 25 operatively connected to a drive shaft 26.

The housing assembly further includes a dynamic seal assembly, the drive shaft 26 extends into the pumping chamber 25 through the dynamic seal assembly which includes a seal chamber 31 having an expeller 32 therein. The seal chamber 31 is in communication with the pumping chamber 25 via connecting passage 33.

Figure 6:
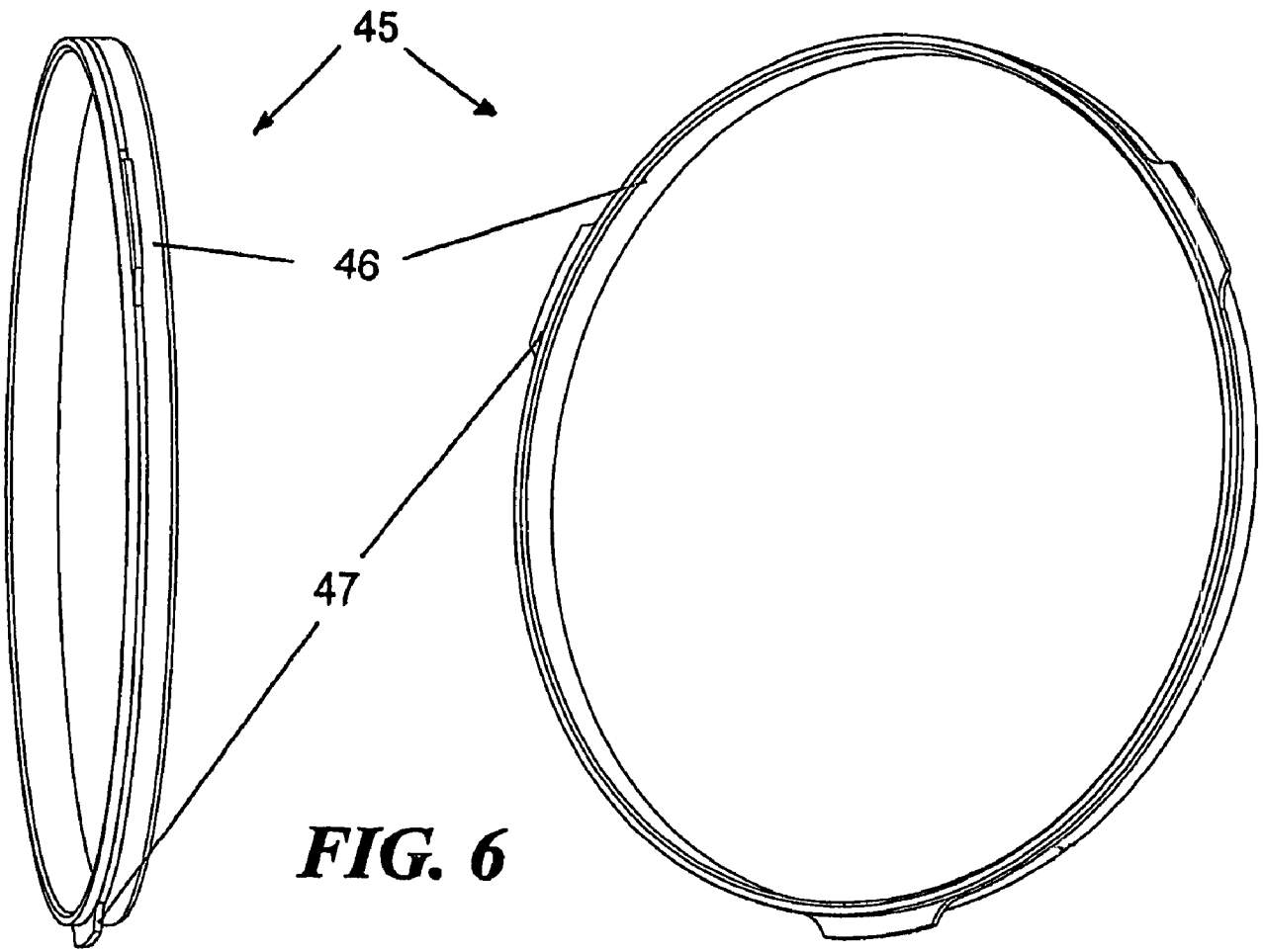
FIGS. 6 and 7 are illustrations of two forms of shearing elements according to the invention.
Figure 7:
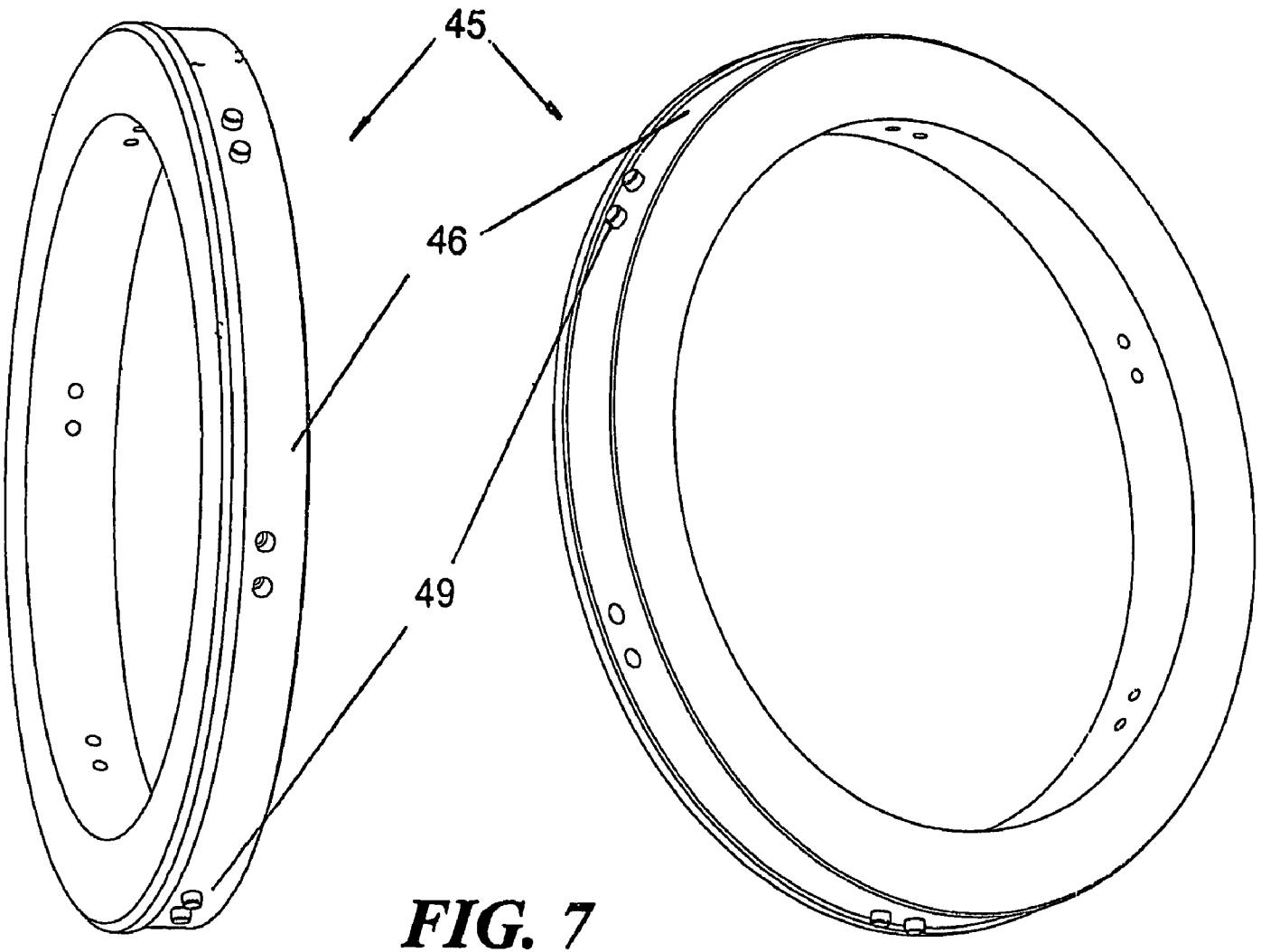

The dynamic seal assembly further includes an outer seal wall 40 which includes a side wall section 41 and a peripheral wall section 42. The seal wall is adapted to be mounted in a normal operating position relative to the pump casing. To this end the seal wall 40 and casing part 13 having cooperating shoulders 43 and 44 with a shearing element 45 therebetween. As shown in FIG. 6 the shearing element 45 includes a ring 46 having one or more shearing flanges 47 projecting radially from the ring. In the normal operating position one side edge of the ring abuts against shoulder 44 and the shearing flange abuts against shoulder 43. As is apparent from FIG. 2 of the drawings, in the installed position shoulders 43 and 44 are spaced apart. Bolts 48 retain the two parts in the normal operating position. The edge of the peripheral wall section includes a sealing element which may be in the form of an O-ring 29 which provides a seal between the wall and the rear section of the liner 23. In the embodiment of FIG. 7 the flanges 47 are replaced by shear pins 49.

It will be appreciated that any pressure within the seal chamber will cause an axial force be applied to the shear ring. The material of the shear ring can be metal or non-metal provided such material has consistent mechanical strength properties. As described earlier, the shearing element includes a ring shaped body 46 with preferably two or more flanges or lugs 47 on its outer diameter. The axial force generated by slurry pressure occurring in the pump is transferred into these lugs or flanges. The lugs are sized so that the area under shear stress is calculated commensurate with the size of the pump and the desired pressure at which failure of the shear ring will occur. The dimensions of each lug can be varied to vary the area under shear and thereby varying the pressure at which failure of the shear ring will occur.

The shearing element is designed in such a manner that when the pump internal pressure increases to a predetermined value due to say a blockage and zero or near zero flowrate, the lugs will fail thereby allowing the seal chamber wall 40 to move axially outwards from the pump casing section 13. This movement unseats or blows out the seal 29 between the seal chamber and the internal pump liner (eg O-ring) and allows escape of slurry thus relieving the internal over pressure within the pump. The movement of wall 40 and venting is shown by the arrows in FIG. 1.

The pressure at which the shearing element fails could be set between the pump's maximum allowable operating pressure rating and its maximum allowable test pressure. Specifying a pressure in this range means that the pump components and bolting are not overstressed during the over-pressurisation and can be safely re-used following the replacement of the failed shearing element.

When the seal between liner and seal chamber leaks, the over-pressurisation is relieved inside the pump. As the shear ring has failed and the seal chamber seal has been displaced axially a leak occurs past the O-ring or elastomeric seal 29. The leak will continue as the seal chamber has been permanently moved out of position.

To facilitate the continued relief of pressure, liquid and solids will be forced out past the seal on the seal chamber and then to atmosphere via a series of grooves or flute like passageways on the periphery of the seal chamber or through the radial side walls of casing section 13. Leakage will therefore be continuous between the seal chamber and the pump casing to the outside atmosphere until the pressure inside the pump is close to atmosphere. Relief of the high pressure and steam will be past the sealing O-ring in the seal chamber as a gap is developed by the failure of the shear ring and the seal chamber moving. Escape to the outside atmosphere could be via slots or grooves in the seal chamber (as described) but escape could also be via special holes in the drive side portion of the pump casing. Vent pipes could be attached to the vent holes in the casing to direct the escaping liquid and steam downwards to the ground. This would provide added safety.

Leakage and spray from the pump may be contained by a guard or the like over the back or drive side of the pump. In another arrangement the venting flow may be guarded and directed downwards towards the ground.

The seal chamber may be free to rotate with the shaft if the shear ring fails and the seal chamber is displaced axially and outwards from the pump. To prevent rotation of the seal chamber, one or more lugs 49 are cast or fitted to the outside diameter of the seal chamber and the lugs are trapped by a stud bolt or similar to prevent rotation.

Figure 4:
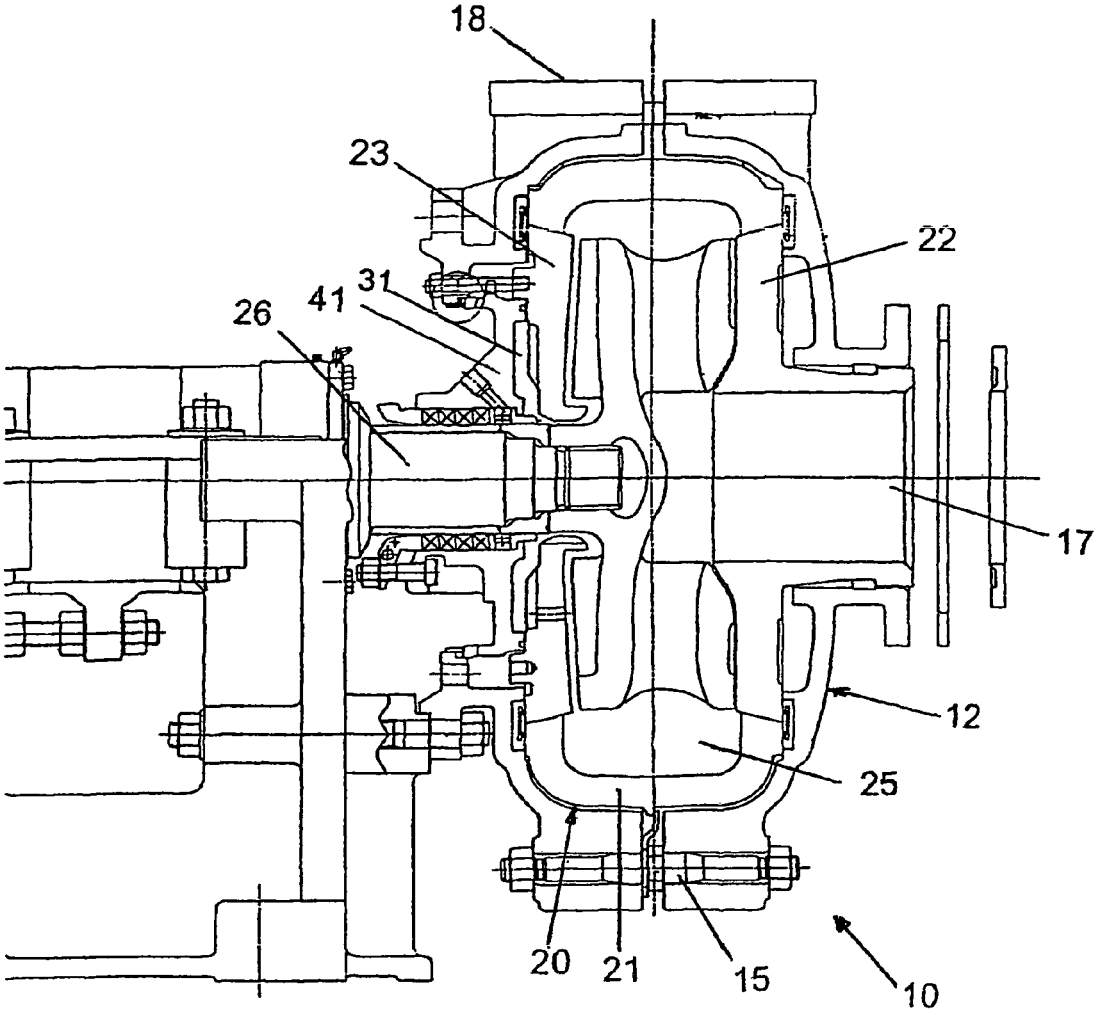
FIG. 4 is a schematic side elevation of a pump according to another embodiment of the invention.
Figure 5:
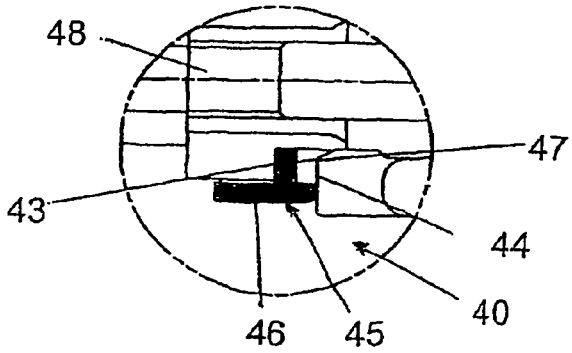
FIG. 5 is a detail from FIG. 4 of a seal ring of the invention.

FIGS. 4 and 5 illustrate a further embodiment of a pump according to the present invention. The same reference numerals have been used to identify the same parts as described with reference to FIGS. 1 to 3.

In this embodiment the dynamic seal assembly of the housing assembly is replaced with a gland seal assembly. The gland seal assembly includes a gland seal housing or stuffing box 41 mounted for axial movement relative to the pump casing, the shearing element 45 being installed and operable in a similar fashion to that described earlier.

Although a clearance 31 is shown it is not essential to the working of the invention. All that is required is that pressure within the pumping chamber can act on the gland seal housing or stuffing box 41.

The invention provides an arrangement with a continual stand-by pressure relieving capability. The invention as configured is largely independent of pump construction, materials from which the pump components are made, pump components used, the pump installation arrangements, and the associated pipework, any adjustments that the pump user is likely to make to the pump rendering the invention as an install and forget over pressure relief protection device.

Advantages of the arrangement include the following: the element fails at a safe pressure and not the pump; ie the pump is unaffected. The failure pressure is well within the pumps maximum design pressure. The pump can be re-used by removing and replacing the failed element with a new one. The leakage is contained and controlled. There is no possibility of pieces 'flying' following a failure. The element is retroffitable when the element fails, none of the other pump parts are put at subsequent risk of failing such as might be the case if the impeller rubbed on the casing due to misalignment immediately following failure.

Finally, it is to be understood that various alterations, modifications and/or additions may be incorporated into the various constructions and arrangements of parts without departing from the spirit or ambit of the invention.

I claim:

1. A pressure relief arrangement in a pump comprising a pump housing assembly including a pump casing with a pumping chamber, a pump inlet and outlet and an impeller provided in the pumping chamber which is driven by a drive shaft, the pump housing assembly including a movable section mounted for movement between a normal operating position and a venting position, a shearing element being adapted to retain the movable section in the normal operating position, the movable section being mounted so that pressure within the pumping chamber can act on the section, the arrangement being such that upon the pressure within the pumping chamber reaching a specified pressure the shearing element will fail thereby permitting movement of the movable section from the normal operating to the venting position.

2. The pressure relief arrangement according to claim 1 wherein the pump housing assembly includes a sealing chamber therein which is in fluid communication with said pumping chamber through a connecting passage, the sealing chamber including a side wall section forming said movable section mounted for movement between the normal operating position and the venting position, the shearing element being adapted to retain the side wall section in the normal operating position, the arrangement being such that upon the pressure within the sealing chamber reaching a specified pressure, the shearing element will fail thereby permitting movement of the side wall section from the normal operating position to the venting position.

3. The pressure relief arrangement according to claim 2 wherein the side wall section is mounted relative to the pump casing, each having cooperating shoulders thereon and the shearing element being adapted to be disposed therebetween, the shearing element including a ring shaped body having one or more shearing members projecting generally radially therefrom, the arrangement being such that in the installed position, one side edge of the ring is adapted to abut against one of the shoulders and the shearing member is adapted to abut against another of the shoulders, the shoulders of the parts being spaced apart so that on failure of the shearing element, axial movement between the two parts is permitted.

4. The pressure relief arrangement according to claim 3 wherein the or each shearing member is in the form of a flange or lug projecting from the ring.

5. The pressure relief arrangement according to claim 3 wherein the or each shearing member is in the form of a shear pin mounted to and projecting from the ring.

6. The pressure relief arrangement according to claim 3 further including means for inhibiting rotation of the side wall.

7. The pressure relief arrangement according to claim 2 further including means for inhibiting rotation of the side wall.

8. The pressure relief arrangement according to claim 7 wherein the or each shearing member is in the form of a flange or lug projecting from the ring.

9. The pressure relief arrangement according to claim 7 wherein the or each shearing member is in the form of a shear pin mounted to and projecting from the ring.

* * * * *